US006714755B2

(12) United States Patent
Abe

(10) Patent No.: US 6,714,755 B2
(45) Date of Patent: Mar. 30, 2004

(54) BELT STRETCHER AND COLOR IMAGE FORMATION APPARATUS INCORPORATING THE SAME

(75) Inventor: Nobumasa Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/013,948

(22) Filed: Dec. 13, 2001

(65) Prior Publication Data

US 2002/0085864 A1 Jul. 4, 2002

(30) Foreign Application Priority Data

Dec. 21, 2000 (JP) ..... P.2000-389240
Dec. 21, 2000 (JP) ..... P.2000-389241
Dec. 22, 2000 (JP) ..... 2000-390185
Dec. 22, 2000 (JP) ..... 2000-390186

(51) Int. Cl.[7] ..... G03G 15/01
(52) U.S. Cl. ..... 399/302; 399/350
(58) Field of Search ..... 399/298, 299, 399/302, 303, 308, 312, 313, 165

(56) References Cited

U.S. PATENT DOCUMENTS 5,585,906 A 12/1996 Takahashi et al.
5,987,291 A 11/1999 Masuda
6,029,022 A * 2/2000 Takase ..... 399/299
6,125,994 A * 10/2000 Todome ..... 399/303
6,134,415 A * 10/2000 Iwakura et al. ..... 399/299
6,141,525 A 10/2000 Tahara
6,198,899 B1 * 3/2001 Takahashi et al. ..... 399/303
6,236,828 B1 * 5/2001 Munenaka et al. ..... 399/303
6,298,586 B1 * 10/2001 Todome ..... 399/303
6,321,052 B1 * 11/2001 Yamashina et al. ..... 399/165
6,337,967 B1 * 1/2002 Izumi et al. ..... 399/302
6,389,260 B1 * 5/2002 Kataoka et al. ..... 399/298
6,397,033 B1 * 5/2002 Todome ..... 399/303
2002/0001489 A1 * 1/2002 Ozaki et al. ..... 399/298
2002/0001490 A1 * 1/2002 Morikami et al. ..... 399/298

FOREIGN PATENT DOCUMENTS

EP 1239337 A1 9/2002
JP 3-191368 A 8/1991
JP 5-52244 A 3/1993
JP 2000-098694 4/2000

OTHER PUBLICATIONS

Patent Abstracts of Japan for JP 2000–098694; (published—Apr. 7, 2000; Applicant: Canon, Inc.) European Search Report.

* cited by examiner

*Primary Examiner*—Susan S. Y. Lee
(74) *Attorney, Agent, or Firm*—Sughrue Mion, PLLC

(57) ABSTRACT

A looped belt is stretched by a drive roller and a driven roller and circulated therearound. The driven roller is capable of functioning as a regulation roller for regulating meander action in the belt. Each of image formers forms a toner image associated with each single color constituting a color image. Transferring members are disposed on a circulating path of the belt member. Each transferring member is associated with each image former for transferring the toner image onto either the belt member or a recording medium held on the belt member. A cleaning blade is abutted against a part of the belt member wound on the drive roller for removing toner remained on the belt member after the toner image transfer is performed.

41 Claims, 11 Drawing Sheets

BELT STRETCHER AND COLOR IMAGE FORMATION APPARATUS INCORPORATING THE SAME

BACKGROUND OF THE INVENTION

This invention relates to a belt stretcher that can be downsized, and a color image formation apparatus incorporating the same, in particular to a so-called tandem color image formation apparatus for transferring toner images formed by a plurality of single-color toner image formers in sequence to a belt or a recording medium held on the belt, thereby forming a color image.

Generally, each toner image former has a photoconductor having a photosensitive layer on the outer peripheral surface, a charger for uniformly charging the outer peripheral surface of the photoconductor, an exposer for selectively exposing the outer peripheral surface charged uniformly by the charger for forming an electrostatic latent image, and a developer for giving toner to the electrostatic latent image formed by the exposer for providing a visible image (toner image).

The known tandem image formation apparatus for forming a color image is of the type wherein a plurality of (for example, four) toner image formers as mentioned above are placed for an intermediate transfer belt and toner images on photoconductors provided by the single-color toner image formers are transferred to the intermediate transfer belt in sequence for superposing the toner images of a plurality of colors (for example, yellow, cyan, magenta, and black) on the intermediate transfer belt, thereby providing a color image on the intermediate transfer belt. Another known tandem image formation apparatus is of the type wherein a recording medium, such as paper, is held on a recording medium holding belt and toner images provided by a plurality of single-color toner image formers are transferred to the recording medium in sequence for superposing the toner images of a plurality of colors on the recording medium, thereby providing a color image on the recording medium.

The tandem color image formation apparatus of each type comprises a meander regulation (meander prevention) mechanism because a color shift occurs if the belt meanders.

An apparatus as shown in FIG. 10 is a related tandem image formation apparatus for forming a color image (disclosed in Japanese Patent Publication No. 3-191368A).

In this image formation apparatus, a plurality of (in this case, four) single-color toner image formers 101 (A, B, C, and D) are placed for an intermediate transfer belt 100.

Each single-color toner image former 101 has a photoconductor 102 having a photosensitive layer on the outer peripheral surface, a charger 103 for uniformly charging the outer peripheral surface of the photoconductor 102, an exposer 104 for selectively exposing the outer peripheral surface charged uniformly by the charger 103 for forming an electrostatic latent image, and a developer 105 for giving toner to the electrostatic latent image formed by the exposer 104 for providing a visible image (toner image).

The toner images on the photoconductors 102 provided by the single-color toner image formers 101 are primarily transferred to the intermediate transfer belt 100 in sequence by corona transfer devices 106 for superposing the toner images of a plurality of colors (for example, yellow, cyan, magenta, and black) in sequence on the intermediate transfer belt 100, thereby providing a color image on the intermediate transfer belt 100, and the color image is secondarily transferred from the intermediate transfer belt 100 to a recording medium P by a corona transfer device 110 in a secondary transfer section T2.

The recording medium P is supplied one at a time from a paper feeding cassette 107 by a paper feeding belt 108 and passes through gate rollers 109. In the secondary transfer section T2, a color toner image is transferred to the recording medium P. After then, the recording medium P is transported on an attractive transport belt 111. The color toner image is fixed by a fixing section 112 and the recording medium P is ejected onto a paper ejection tray 114 by ejection rollers 113.

Each single-color toner image former 101 is provided with a cleaning blade 115 for removing toner remaining on the surface of the photoconductor 102 after the toner image is transferred to the intermediate transfer belt 100, and the intermediate transfer belt 100 is provided with a cleaning blade 120 for removing toner remaining thereon after the secondary transfer.

The intermediate transfer belt 100 is placed on a drive roller 130 and a driven roller 131, and a tension roller 132 is placed on a slack side 100*a* of the intermediate transfer belt 100. A press roller 133 for pressing the intermediate transfer belt 100 against the photoconductor 102 is placed on a tense side 100*b* of the intermediate transfer belt 100.

The cleaning blade 120 abuts the intermediate transfer belt 100 in a winding part of the intermediate transfer belt 100 around the driven roller 131. Numeral 116 denotes a sensor for detecting a reference position of the belt.

The cleaning blade 120 acts on circulation of the intermediate transfer belt 100 as resistance. It acts as large resistance particularly when the drive roller 130 is activated (when circulating the belt is started).

In the related image formation apparatus, the cleaning blade 120 abuts the intermediate transfer belt 100 in the winding part of the intermediate transfer belt 100 around the driven roller 131 and thus the resistance of the cleaning blade 120 in the abutment part acts on the intermediate transfer belt 100 as a tensile force between the winding part and the winding part of the belt around the drive roller 130.

The abutment state of the cleaning blade 120 on the intermediate transfer belt 100 is not always stable because of the friction therebetween and becomes unstable particularly at the initial stage of driving. Therefore, in this stage, the tension acting on the intermediate transfer belt 100 between the drive roller 130 and the cleaning blade 120 also becomes unstable.

Therefore, the expansion and contraction state of the intermediate transfer belt 100 becomes unstable so that a shift between the transfer positions of color toner images onto the intermediate transfer belt 100 easily occurs. Consequently, the quality of a color image is easily degraded.

In this kind of color image formation apparatus, if the intermediate transfer belt meanders, a shift between colors occurs and thus it is desirable that a meander regulation (meander prevention) mechanism should be provided. In the apparatus as described above, the secondary transfer section T2 is formed in the winding part of the intermediate transfer belt 100 around the driven roller 131. Thus, it is undesirable that the driven roller 131 is used as a meander regulation roller. Since meander of the intermediate transfer belt is mainly regulated in the process from the winding start position of the intermediate transfer belt around the meander regulation roller to the winding end part, the intermediate transfer belt is easily displaced in the width direction thereof in the winding part and therefore the state of the secondary transfer easily becomes unstable.

Thus, in the apparatus as described above, the tension roller 132 or the press roller 133 needs to be used as a meander regulation roller.

However, in such a configuration, it is impossible to eliminate the tension roller 132 or the press roller 133 contrary to the requirement of simplification or downsizing of the apparatus. In addition, as seen in FIG. 10, the winding angle of the intermediate transfer belt 100 around the tension roller 132, the press roller 133 is small and thus it is hard to provide a sufficient meander regulation effect.

As a belt stretcher having a meander regulation mechanism, a mechanism as shown in FIG. 11 is known (disclosed in Japanese Patent Publication No. 5-52244A).

In the figure, a belt 3 is placed on a drive roller 1 and a driven roller 2 and circulated in the arrow A direction, with a driving force provided from a drive motor 4.

The driven roller 2 is provided as a regulation roller for regulating meander and at least one end 2*c* of the driven roller 2 is supported so that it can be moved in the arrow C direction for regulating meander.

The driven roller (regulation roller) 2 is provided at the end 2*c* with a tapered detection roller 5 (shaped like a truncated cone) that can be rotated independently of a roller main body 2*b* with respect to a shaft 2*d*, and a string member 7 wound around a boss part 5*b* of the detection roller 5 for joint is fixed to a frame S at an opposite end thereof.

Initially, the driven roller (regulation roller) 2 is placed so that as the axis-to-axis distance between the driven roller 2 and the drive roller 1, L2 on the side of a move end 2*c* is a little shorter than L1 on the side of a fixed end 2*a* and accordingly initially the belt 3 moves in the arrow B direction. However, when the belt 3 moves in the arrow B direction and an edge part 3*a* of the belt 3 is wound around a taper face of the detection roller 5, the detection roller 5 is rotated following the belt 3, whereby the string member 7 is wound around the boss part 5*b* of the detection roller 5 and is pulled and the free end 2*c* is pulled in the arrow C direction by reaction force and the above-mentioned axis-to-axis distance L2 on the move end 2*c* side becomes larger than the axis-to-axis distance L1 on the fixed end 2*a* side. Accordingly, the belt 3 moves in an opposite direction to the arrow B and consequently meander of the belt 3 is regulated.

According to such a belt stretcher, it is made possible to downsize the belt stretcher (and therefore downsize an image formation apparatus). That is, to regulate meander of a belt in a general belt stretcher, it is common practice to provide a third roller and implement the third roller as a meander regulation roller and thus at least three rollers are required, but the belt stretcher described with reference to FIG. 11 makes the third roller unnecessary and requires only two rollers, so that it is made possible to downsize the belt stretcher (and therefore downsize an image formation apparatus).

A belt less stretched to prevent a position shift of an image is used as a belt used with an image formation apparatus (for example, an intermediate transfer belt).

Thus, in fact, the belt stretcher in the related art shown in FIG. 11 is hard to provide the desired motion described above.

For example, to provide the desired motion described above, it is considered that the one end 2*a* of the regulation roller 2 is supported immovably and that only the opposite end 2*c* is supported movably in the arrow C direction. In doing so, however, it becomes difficult to give a predetermined tension to the belt 3, because the rollers 1 and 2, the belt 3, and the support members of the rollers 1 and 2 contain their respective dimension errors and an error also occurs in the axis-to-axis distance on the fixed end 2*a* side.

To make it possible to give a predetermined tension to the belt 3, for example, in FIG. 11, both the ends 2*a* and 2*c* of the regulation roller 2 may be urged (F1 and F2) initially by springs or the like, in the stretching direction of the belt 3 and the urging force F2 on the free end 2*c* side may be set a little smaller than the urging force F1 on the fixed end 2*a* side. However, to provide the desired motion described above, urging force F3 is required for urging the free end 2*c* of the regulation roller 2 in the former position direction (opposite to the arrow C direction) after the free end 2*c* moves in the arrow C direction.

However, in the belt stretcher shown in FIG. 11, the free end 2*c* of the regulation roller 2 moves in the initial stretching direction of the belt 3 (arrow C direction) and thus the urging force F3 cannot be set, because the urging force F3 and the urging force F2 cancel each other out. Therefore, the belt stretcher shown in FIG. 11 is hard substantially to provide the desired motion described above.

The problem described above can be solved by setting the moving direction of the regulation roller for meander regulation to any other direction than the initial stretching direction of the belt by the regulation roller.

In doing so, however, another problem arises as described below:

In a tandem color image formation apparatus, a plurality of single-color toner image formers are placed for a belt and toner images are transferred to the belt or a recording medium held on the belt. If the moving direction of the regulation roller for meander regulation is set to any other direction than the initial stretching direction of the belt by the regulation roller, the belt is displaced in a direction away from or close to the single-color toner image formers.

If the belt is displaced in the direction away from the single-color toner image formers, it is feared that the contact state between the belt and each toner image former (photoconductor thereof, for example) may become unstable in the transfer section, causing a transfer failure to occur.

If the belt is displaced toward the image formers, the winding angle of the belt with respect to the photoconductor, for example, in the toner image former closest to the regulation roller grows and the transfer bias fluctuates and thus it is still feared that a transfer failure may occur.

SUMMARY OF THE INVENTION

It is therefore a first object of the invention to provide a color image formation apparatus that can decrease a shift between the transfer positions of color toner images onto an intermediate transfer belt for enhancing the quality of a color image.

A second object of the invention to provide a color image formation apparatus that can lessen the number of rollers for downsizing the apparatus, and moreover can provide a sufficient meander regulation effect for consequently improving the image quality.

A third object of the invention to provide a color image formation apparatus that can provide a good transfer state although the moving direction of the regulation roller-for meander regulation is set to any other direction than the initial stretching direction of the belt by the regulation roller.

In order to achieve the above objects, according to the present invention, there is provided a color image formation apparatus, comprising:

a drive roller;

a driven roller;

a looped belt member, which is stretched by the drive roller and the driven roller and circulated therearound;

a plurality of image formers, each image former forms a toner image associated with each single color constituting a color image;

a plurality of transferring members, disposed on a circulating path of the belt member, each transferring member being associated with each image former for transferring the toner image onto either the belt member or a recording medium held on the belt member; and a cleaning blade, abutted against a part of the belt member wound on the drive roller for removing toner remained on the belt member after the toner image transfer is performed.

In this configuration, since the cleaning blade abuts against the part of the belt member wound on the drive roller, the expansion and contraction state of the intermediate transfer belt becomes stable even at the initial stage of driving.

That is, as described above, the cleaning blade acts on circulation of the belt member as resistance and becomes large resistance particularly when driving is started. However, in the above configuration, the resistance of the cleaning blade in the abutment part cannot act as a tensile force of the belt member. It acts only on the winding part of the belt member around-the drive roller as resistance.

Thus, if the abutment state of the cleaning blade on the belt member is not stable because of the friction therebetween, the state does not affect any tension acting on the belt member.

Therefore, a shift between the transfer positions of color toner images onto the belt member or the recording medium is remarkably decreased even at the initial stage of image formation, and consequently the quality of a color image is enhanced.

Preferably, a friction coefficient of an outer peripheral surface of the drive roller is larger than a friction coefficient of an inner surface of the looped belt member.

In this configuration, the circulation of the belt member becomes further stable and therefore the expansion and contraction state of the belt member also becomes further stable.

Here, it is preferable that the drive roller serves as a secondary transfer member together with a secondary transfer roller in a case where the toner images are primarily transferred onto the belt member. A hardness of the outer peripheral surface of the drive roller is smaller than a hardness of the secondary transfer roller.

In this configuration, since a nip face in the secondary transfer section becomes a curved surface recessed to the side of the drive roller, a good strip property of the recording medium from the belt member in the secondary transfer section can be provided, and winding the recording medium around the belt member can be prevented.

Preferably, the driven roller serves as a regulation roller, which moves in a direction other than a direction in which the driven roller initially stretches the belt member to regulate meander action of the belt member.

In this configuration, since it is not necessary to provide any roller member other than the drive roller and the driven roller to regulate the meander action of the belt member, the apparatus can be downsized.

Here, it is preferable that the driven roller moves in a direction perpendicular to the initial stretching direction.

In this configuration, the meander action of the belt member can be regulated more efficiently. Moreover, it is made possible to fine regulation.

Alternatively, it is preferable that the driven roller moves in a direction such that a part of the belt member at which a transferring member closest to the driven roller is separated from the associated image former.

In this configuration, the winding angle of the belt member with respect to the image former does not grow and the fear of occurrence of a transfer failure is eliminated.

Therefore, a good transfer condition can be attained although the moving direction of the driven roller for meander regulation is set to any other direction than the initial stretching direction.

Here, it is preferable that the transferring member closest to the driven roller is provided as a transfer roller for urging the belt member toward the associated image former with an urging force greater than a force produced when the driven roller regulates the meander action of the belt member.

In this configuration, the contact state between the belt member and the image former becomes stable, causing no transfer failure to occur. Even if the urging force of the transfer roller is increased, the frictional force with the belt member does not grow and consequently a smooth running state of the belt member can be provided.

Further, it is preferable that the transferring members other than the transfer roller are provided as either transfer blades.

In this configuration, it is made possible to provide an inexpensive image formation apparatus with a simple structure as compared with the case where all transferring members are implemented as transfer rollers.

Alternatively, it is preferable that the color image formation apparatus further comprises a positioning member disposed between the driven roller and the transferring member closest to the driven roller, the positioning member being abutted against an inner surface of the looped belt member. Here, a friction coefficient of an abutting surface of the positioning member is less than a friction coefficient of the inner surface of the looped belt member.

In this configuration, even if the driven roller is displaced, the contact between the belt member and the toner image former becomes stable, causing no transfer failure to occur.

Since the positioning member has a good sliding proper relative to the belt member, the frictional force with the belt member does not much grow and consequently a smooth running state of the belt member can be provided.

Here, it is preferable that all of the transferring members are provided as either transfer blades or corona transfer devices.

In this configuration, since the need for implementing transfer rollers as the transferring members is eliminated, it is made possible to provide an inexpensive image formation apparatus with a simple structure.

Preferably, the drive roller serves as a secondary transfer member together with a secondary transfer roller in a case where the toner images are primarily transferred onto the belt member. Here, a diameter of the driven roller is larger than a diameter of the drive roller.

In this configuration, since the drive roller, which is a main factor member of causing meander to occur, has a smaller diameter than the driven roller, the meander distance itself of the intermediate transfer belt is decreased.

On the other hand, since the driven roller implemented as the meander regulation roller of the intermediate transfer belt has a larger diameter than the drive roller, and thus the winding length of the belt member is enlarged so that the meander of the belt member is regulated reliably and smoothly.

Therefore, the color image formation apparatus can provide a sufficient meander regulation effect and consequently the image quality is improved.

Further, meander regulation rollers other than the driven roller become unnecessary, so that it is made possible to downsize the apparatus.

Still further, the secondary transfer section is formed in the winding part of the belt member around the drive roller which is not the meander regulation roller, so that a stable secondary transfer state can be provided.

Moreover, the drive roller forming the secondary transfer section has a small diameter, so that the strip property of the recording medium from the secondary transfer section is improved and winding trouble of the-recording medium becomes hard to occur.

According to the present invention, there is also provided a color image formation apparatus, comprising:

a drive roller;

a driven roller;

a looped belt member, which is stretched by the drive roller and the driven roller and circulated therearound;

a plurality of image formers, each image former forms a toner image associated with each single color constituting a color image; and a plurality of transferring members, disposed on a circulating path of the belt member, each transferring member being associated with each image former for transferring the toner image onto either the belt member or a recording medium held on the belt member, wherein:

the driven roller serves as a regulation roller, which moves in a direction other than a direction in which the driven roller initially stretches the belt member such that a part of the belt member at which a transferring member closest to the driven roller is separated from the associated image former, in order to regulate meander action of the belt member; and the transferring member closest to the driven roller is provided as a transfer roller for urging the belt member toward the associated image former with an urging force greater than a force produced when the driven roller regulates the meander action of the belt member.

According to the present invention, there is also provided a color image formation apparatus, comprising:

a drive roller;

a driven roller;

a looped belt member, which is stretched by the drive roller and the driven roller and circulated therearound;

a plurality of image formers, each image former forms a toner image associated with each single color constituting a color image;

a plurality of transferring members, disposed on a circulating path of the belt member, each transferring member being associated with each image former for transferring the toner image onto either the belt member or a recording medium held on the belt member; and a positioning member disposed between the driven roller and a transferring member closest to the driven roller, the positioning member being abutted against an inner surface of the looped belt member, wherein:

the driven roller serves as a regulation roller, which moves in a direction other than a direction in which the driven roller initially stretches the belt member such that a part of the belt member at which the transferring member closest to the driven roller is separated from the associated image former, in order to regulate meander action of the belt member; and a friction coefficient of an abutting surface of the positioning member is less than a friction coefficient of the inner surface of the looped belt member.

According to the present invention, there is also provided a color image formation apparatus, comprising:

a drive roller having a first diameter;

a driven roller having a second diameter larger than the first diameter;

a looped belt member, which is stretched by the drive roller and the driven roller and circulated therearound;

a plurality of image formers, each image former forms a toner image associated with each single color constituting a color image;

a plurality of transferring members, disposed on a circulating path of the belt member, each transferring member being associated with each image former for primarily transferring the toner image onto the belt member; and a secondary transfer roller, which urges the belt member toward the drive member to transfer the toner image on the belt member onto a recording medium placed therebetween.

According to the present invention, there is also provided a belt stretcher, comprising:

a drive roller;

a driven roller; and a looped belt member, which is stretched by the drive roller and the driven roller and circulated therearound, wherein the driven roller serves as a regulation roller, which moves in a direction other than a direction in which the driven roller initially stretches the belt member.

In this configuration, the urging force for urging the driven roller to the initial position after the meander regulation is not offset by the initial urging force for stretching the belt member. Since it is not necessary to provide any roller member other than the drive roller and the driven roller to regulate the meander action of the belt member, the apparatus can be downsized.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there are shown preferred embodiments of the invention.

Figure 1:
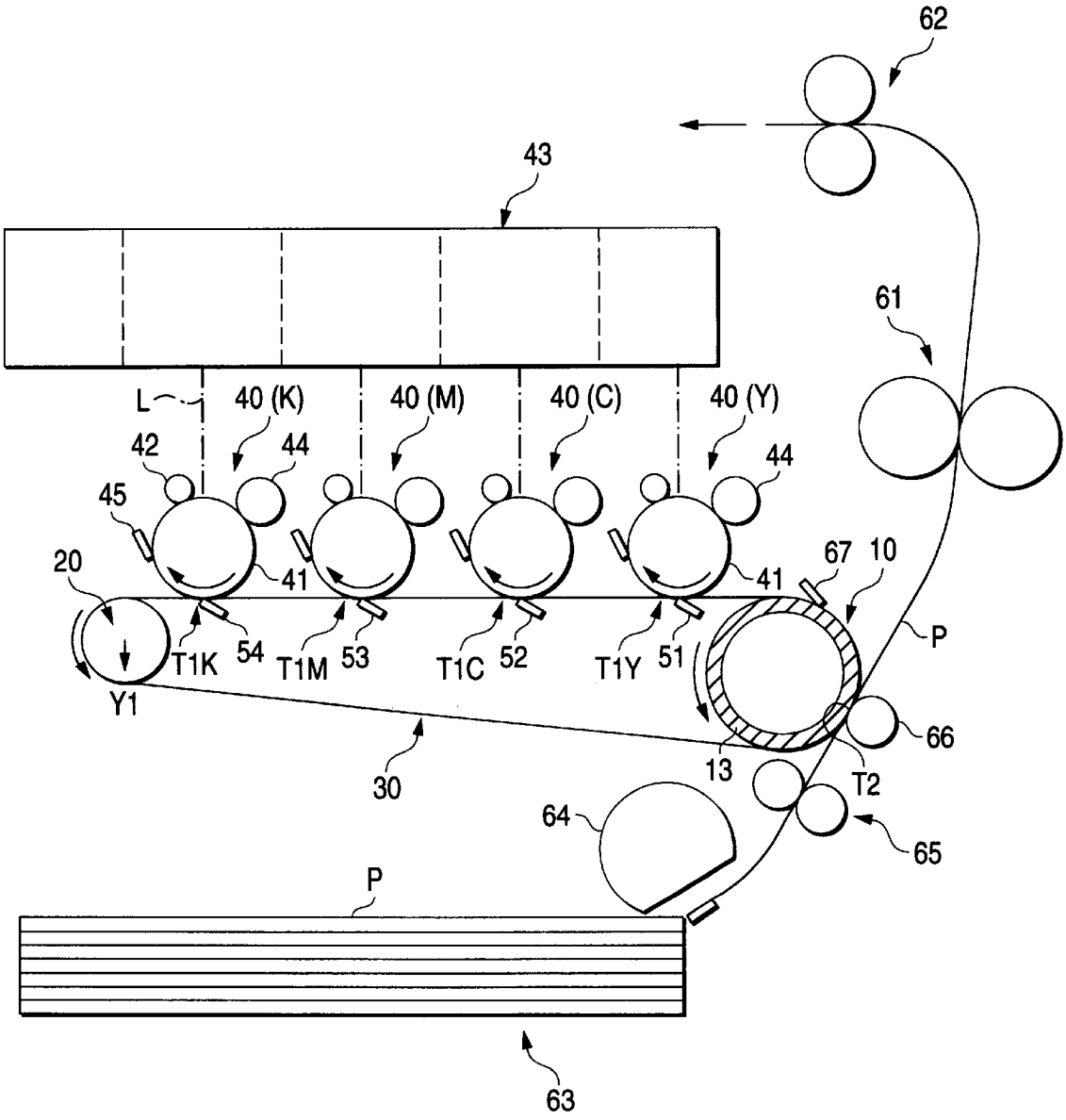
FIG. 1 is a schematic front view to show a color image formation apparatus according to a first embodiment of the invention.

FIG. 1 is a schematic front view to show a color image formation apparatus according to a first embodiment of the invention.

As shown in the figure, the color image formation apparatus comprises an intermediate transfer belt 30 placed on two rollers of a drive roller 10 and a driven roller 20 and circulated in the arrow direction shown (counterclockwise) and a plurality of (four) single-color toner image formers 40 (Y, C, M, and K) placed for the intermediate transfer belt 30, and transfers toner images provided by the plurality of single-color toner image formers 40 to the intermediate transfer belt 30 in sequence by separate transferring members 51, 52, 53, and 54. Primary transfer sections are denoted by T1Y, T1C, T1M, and T1K.

The single-color toner image formers 40(Y) for yellow, 40(M) for magenta, 40(C) for cyan, and 40(K) for black are placed. Each of these single-color toner image formers 40 (Y, C, M, and K) has a photoconductor 41 having a photosensitive layer on the outer peripheral surface, a charging roller 42 for uniformly charging the outer peripheral surface of the photoconductor 41, an exposer 43 for selectively exposing the outer peripheral surface charged uniformly by the charging roller 42 with light (L) for forming an electrostatic latent image thereon, a developing roller 44 for giving toner to the electrostatic latent image formed by the exposer 43 for providing a visible image (toner image), and a first cleaning blade 45 for removing toner remaining on the surface of the photoconductor 41 after the toner image developed by the developing roller 44 is transferred to the intermediate transfer belt 30.

The single-color toner image formers 40 (Y, C, M, and K) are placed on the slack side of the intermediate transfer belt 30.

The full-color toner image provided by primarily transferring toner images in sequence to the intermediate transfer belt 30 and superposing the toner images on each other on the intermediate transfer belt 30 is secondarily transferred to a recording medium P such as paper in a secondary transfer section T2 and is fixed on the recording medium P as it passes through a fixing roller pair 61, then is ejected to a predetermined place (onto a paper ejection tray or the like, not shown) by a paper ejection roller pair 62.

Numeral 63 denotes a paper feeding cassette where recording media P are stacked, numeral 64 denotes a pickup roller for feeding the recording media P one at a time from the paper feeding cassette 63, and numeral 65 denotes a gate roller pair for defining the supply timing of the recording medium P to the secondary transfer section T2.

Numeral 66 denotes a secondary transfer roller for forming the secondary transfer section T2 with the intermediate transfer belt 30, and numeral 67 denotes a second cleaning blade for removing toner remaining on the surface of the intermediate transfer belt 30 after the secondary transfer.

The second cleaning blade 67 abuts the intermediate transfer belt 30 in the winding part of the intermediate transfer belt 30 around the drive roller rather than around the driven roller 20.

Figure 2:
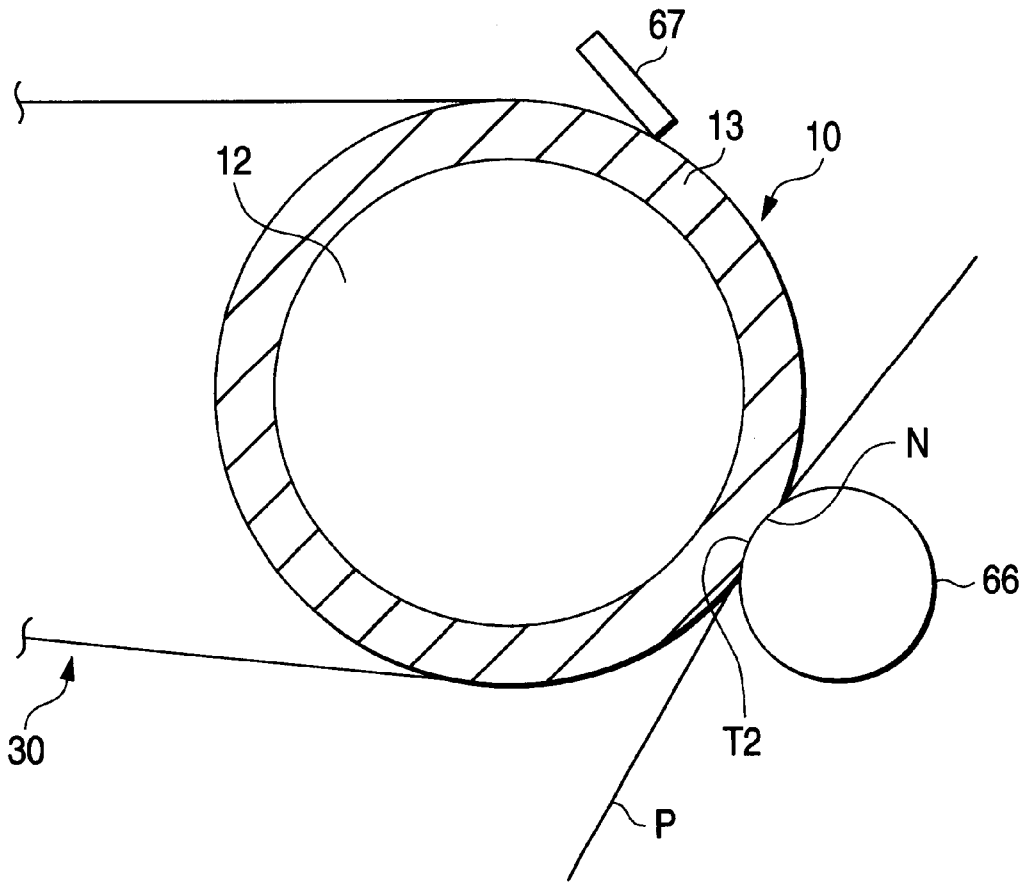
FIG. 2 is an enlarged view of a secondary transfer section of the apparatus in FIG. 1.

As shown in FIG. 2, the drive roller 10 has a core part 12 and a surface layer 13, which is made of a material having large friction against the back face of the intermediate transfer belt 30 (for example, rubber or the like).

The secondary transfer section T2 is implemented as the above-mentioned secondary transfer roller 66 pressed against the drive roller 10 via the intermediate transfer belt 30, and the surface layer 13 of the drive roller 10 is made of an elastic layer having a lower hardness than the secondary transfer roller 66.

As described above, the second cleaning blade 67 acts on circulation of the intermediate transfer belt 30 as resistance and becomes large resistance particularly when the drive roller 10 is activated. However, according to the above configuration, since a second cleaning blade 67 for removing toner remaining on the intermediate transfer belt 30 after the secondary transfer abuts the intermediate transfer belt 30 in the winding part of the intermediate transfer belt 30 around the drive roller 10, the resistance of second cleaning blade 67 in the abutment part cannot act as a tensile force of the intermediate transfer belt 30. It acts only on the winding part of the intermediate transfer belt 30 around the drive roller 10 as resistance.

Thus, if the abutment state of the second cleaning-blade 67 on the intermediate transfer belt 30 is not stable because of the friction therebetween, the state does not affect any tension acting on the intermediate transfer belt 30.

Therefore, the expansion and contraction state of the intermediate transfer belt 30 becomes stable even at the initial stage of driving.

Thus, a shift between the transfer positions of color toner images onto the intermediate transfer belt 30 is remarkably decreased. It becomes hard to occur even at the initial stage of image formation so that the quality of a color image is enhanced.

In addition, since the surface layer 13 of the drive roller 10 is made of a material having large friction against the back of the intermediate transfer belt 30, the drive state of the intermediate transfer belt 30 becomes further stable. Therefore, the expansion and contraction state of the intermediate transfer belt 30 also becomes further stable.

Therefore, the shift between the transfer positions of color toner images onto the intermediate transfer belt 30 is further decreased and the quality of a color image is further enhanced.

Furthermore, since the secondary transfer section T2 is implemented as the secondary transfer roller 66 pressed against the drive roller 10 via the intermediate transfer belt 30 and the surface layer 13 of the drive roller 10 is made of an elastic layer having a lower hardness than the secondary transfer roller 66, a nip face N in the secondary transfer section T2 becomes a surface recessed to the side of the drive roller 10.

Therefore, a good strip state of the recording medium P from the intermediate transfer belt 30 in the secondary transfer section T2 can be provided, and winding the recording medium P around the intermediate transfer belt 30 can be prevented.

Figure 3A:
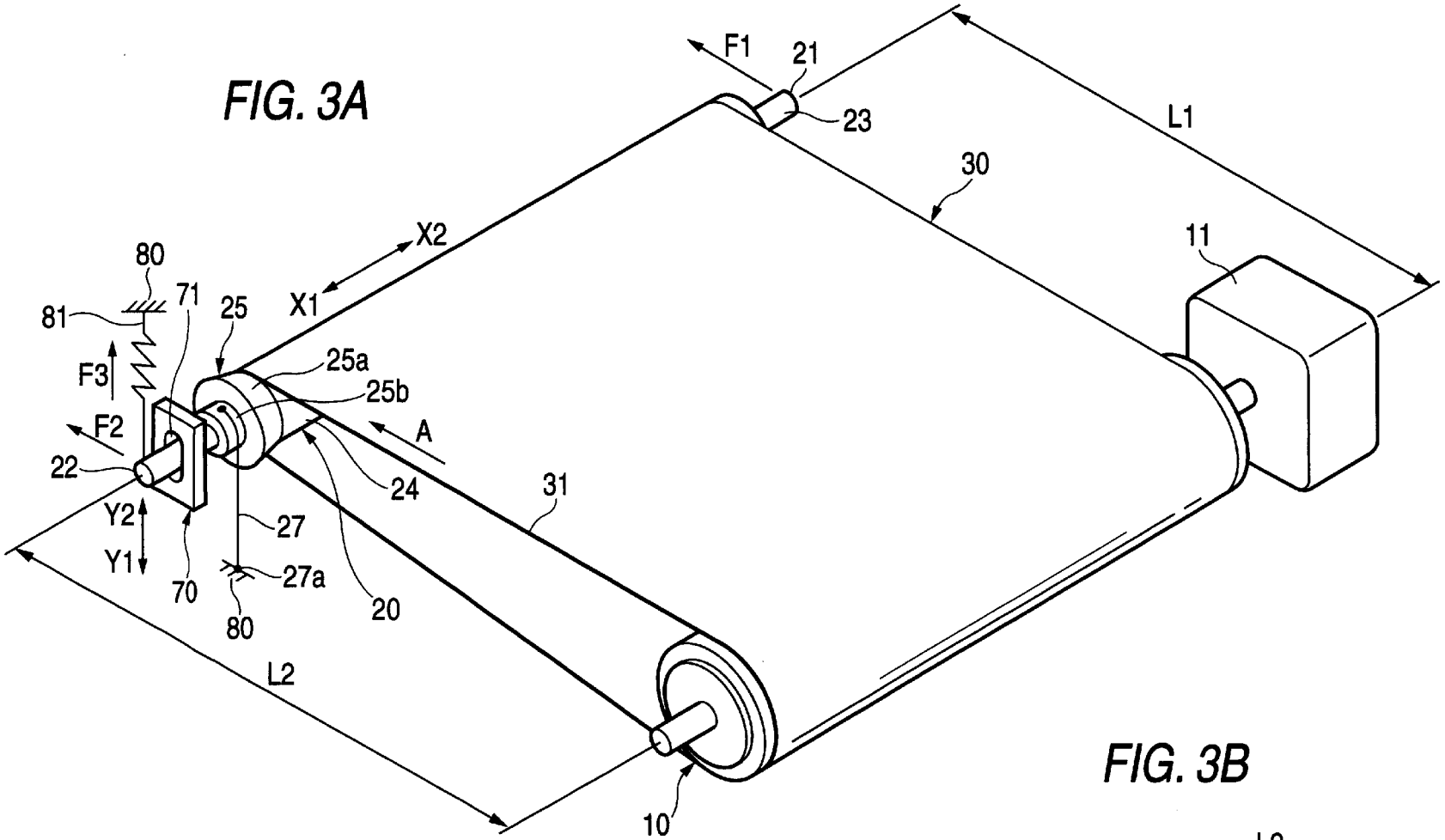
FIG. 3A is a schematic perspective view to show a belt stretcher incorporated in a color image formation apparatus according to a second embodiment of the invention.

FIG. 3A is a schematic perspective view to show a belt stretcher incorporated in a color image formation apparatus according to a second embodiment of the invention. Parts identical with or similar to those previously described with reference to FIG. 1 in the first embodiment are denoted by the same reference numerals in FIG. 3A.

The second embodiment differs from the first embodiment mainly in that a driven roller 20 is used as a regulation roller moved for meander regulation in a direction perpendicular to the axial direction of the roller 20 (arrow X1, X2 direction) to regulate meander of an intermediate transfer belt 30, and that the moving direction of the regulation roller 20 for meander regulation is set to any other direction (see the arrow Y1, Y2 direction) than the initial stretching direction of the belt 30 by the regulation roller 20 (see the arrow F2).

Although the moving direction of the regulation roller 20 for meander regulation may be set to any other direction than the initial stretching direction of the belt 30 by the regulation roller 20(see the arrow F2), in the embodiment, it is set to a direction (arrow Y1, Y2 direction) roughly perpendicular to the initial stretching direction of the belt 30 by the regulation roller 20 (see the arrow F2).

More particularly, a drive roller 10 is rotatively supported at both ends by bearing members (not shown) and is rotated by a drive motor 11. The driven roller 20 serves as the regulation roller as described later. The intermediate transfer belt 30 is circulated in the arrow A direction.

Therefore, single-color toner image formers 40 (Y, C, M, and K) are placed on the slack side of the intermediate transfer belt 30.

A secondary transfer section T2 is formed by the drive roller 10 unchanged in position and a secondary transfer roller 66.

As shown in FIG. 3A, the driven roller (regulation roller) 20 is urged at both ends 21 and 22 initially by urging members such as springs in the stretching direction of the belt 3 (see urging forces F1 and F2) and the urging force F2 on the side of the free end 22 is set a little smaller than the urging force F1 on the side of the fixed end 21.

A movable member 70 is placed at the free end 22 of the regulation roller 20. A slot 71 is formed with the movable member 70 and the free end 22 of the regulation roller 20 is inserted into the slot 71. Therefore, the free end 22 can be moved in the length direction of the slot 71 (arrow Y1, Y2 direction) as it is guided by the slot 71. The movable member 70 can be moved only in the stretching direction of the intermediate transfer belt 30 (arrow F2 direction and opposite direction thereto) and the urging force F2 acts on the movable member 70, whereby the free end 22 of the regulation roller 20 is initially urged in the stretching direction of the intermediate transfer belt 30 by the urging force F2 via the movable member 70. Therefore, the free end 22 can be moved in the arrow Y1, Y2 direction and the arrow F2 direction (and opposite direction thereto). The fixed end 21 of the regulation roller 20 is urged in the F1 direction via the bearing member (not shown) can be moved only in the arrow F1 direction (and opposite direction thereto).

The regulation roller 20 is formed at the free end 22 with a tapered detection roller 25 (shaped like a truncated cone) that can be rotated independently of a roller main body 24 with respect to a shaft 23, and a string member 27 wound around a boss part 25*b* of the detection roller 25 for joint is fixed to a fixation frame 80 at an opposite end 27*a* thereof.

A spring 81 is placed between the free end 22 of the regulation roller 20 and the fixation frame 80 and the free end 22 is urged in the arrow Y2 direction by an urging force F3 of the spring 81. When the intermediate transfer belt 30 stops, a move in the arrow Y2 direction is regulated by the action of the string member 27.

Figure 3B:
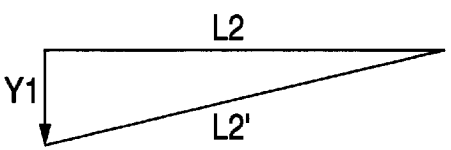
FIG. 3B is a schematic representation of the function of the belt stretcher.

According to the described belt stretcher, as for the urging forces F1 and F2 initially urging both the ends 21 and 22 of the regulation roller 20 in the stretching direction of the belt 30, the urging force F2 on the free end 22 side is set a little smaller than the urging force F1 on the fixed end 21 side, and thus initially as the axis-to-axis distance L2 between the regulation roller 20 and the drive roller 10 on the free end 22 side is a little shorter than the axis-to-axis distance L1 on the fixed end 21 side. Therefore, when the intermediate transfer belt 30 is circulated, initially the belt 30 moves in the arrow X1 direction. However, when an edge part 31 of the belt 30 is wound around a taper face 25*a* of the detection roller 25, the detection roller 25 is rotated following the belt 30, whereby the string member 27 is wound around the boss part 25*b* of the detection roller 25 and is pulled. Incidentally, the free end 22 is pulled in the arrow Y1 direction so that the meander is regulated by reaction force and the above-mentioned axis-to-axis distance L2 on the free end 22 side becomes a distance L2' larger than the axis-to-axis distance L1 on the fixed end 21 side, as shown in FIG. 3B. Accordingly, the belt 30 moves in the arrow X2 direction and consequently meander of the belt 30 is regulated.

According to the configuration as discussed in this embodiment, since the intermediate transfer belt 30 is placed only on the two rollers of the drive roller 10 and the driven roller (regulation roller) 20, it is made possible to downsize the belt stretcher (and therefore downsize the image formation apparatus). That is, to regulate meander of a belt in a-general belt stretcher, it is common practice to provide a third roller and implement the third roller-as a meander regulation roller and thus at least three rollers are required, but the belt stretcher makes the third roller unnecessary and requires only two rollers, so that it is made possible to downsize the belt stretcher (and therefore downsize the image formation apparatus).

Since the moving direction of the regulation roller 20 for meander regulation is set to any other direction than the initial stretching direction (F2) of the belt 30 by the regulation roller 20, the desired meander regulation motion described above can be provided.

In addition, since the moving direction of the regulation roller 20 for meander regulation is set to the direction (Y1) roughly perpendicular to the initial stretching direction (F2) of the belt 30 by the regulation roller 20, meander of the belt 30 can be regulated more efficiently. Moreover, the moving direction (Y1) of the regulation roller 20 for meander regulation is set to the direction roughly perpendicular to the initial stretching direction (F2) of the belt 30 by the regulation roller 20, whereby as seen in FIG. 3B, an increment of the axis-to-axis distance (L2 to L2') becomes small so that it is made possible to finely regulate meander of the belt.

Still further, since the meander regulation move direction (Y1) of the regulation roller 20 is the direction bringing the part of the belt 30 in a primary transfer section T1K (see FIG. 1) closest to the regulation roller 20 away from the single-color toner image former 40(K), the winding angle of the belt 30 with respect to a photoconductor 41 in the primary transfer section T1K does not grow, so that the fear of occurrence of a transfer failure is eliminated.

Displacing of the intermediate transfer belt 30 in the direction bringing the belt 30 away from the single-color toner image formers 40 can be circumvented by implementing at least the primary transferring member closest to the regulation roller 20 as contact-type member (for example, the transfer blade 54 shown in FIG. 1 or the like) for urging the belt 30 toward the single-color toner image former 40 (K) by a larger force than the force produced by the regulation roller 20 for bringing the belt 30 away from the single-color toner image formers 40.

Therefore, the color image formation apparatus can provide a good transfer state although the moving direction of the regulation roller 20 for meander regulation is set to any other direction than the initial stretching direction of the belt 30 by the regulation roller 20.

Figure 4:
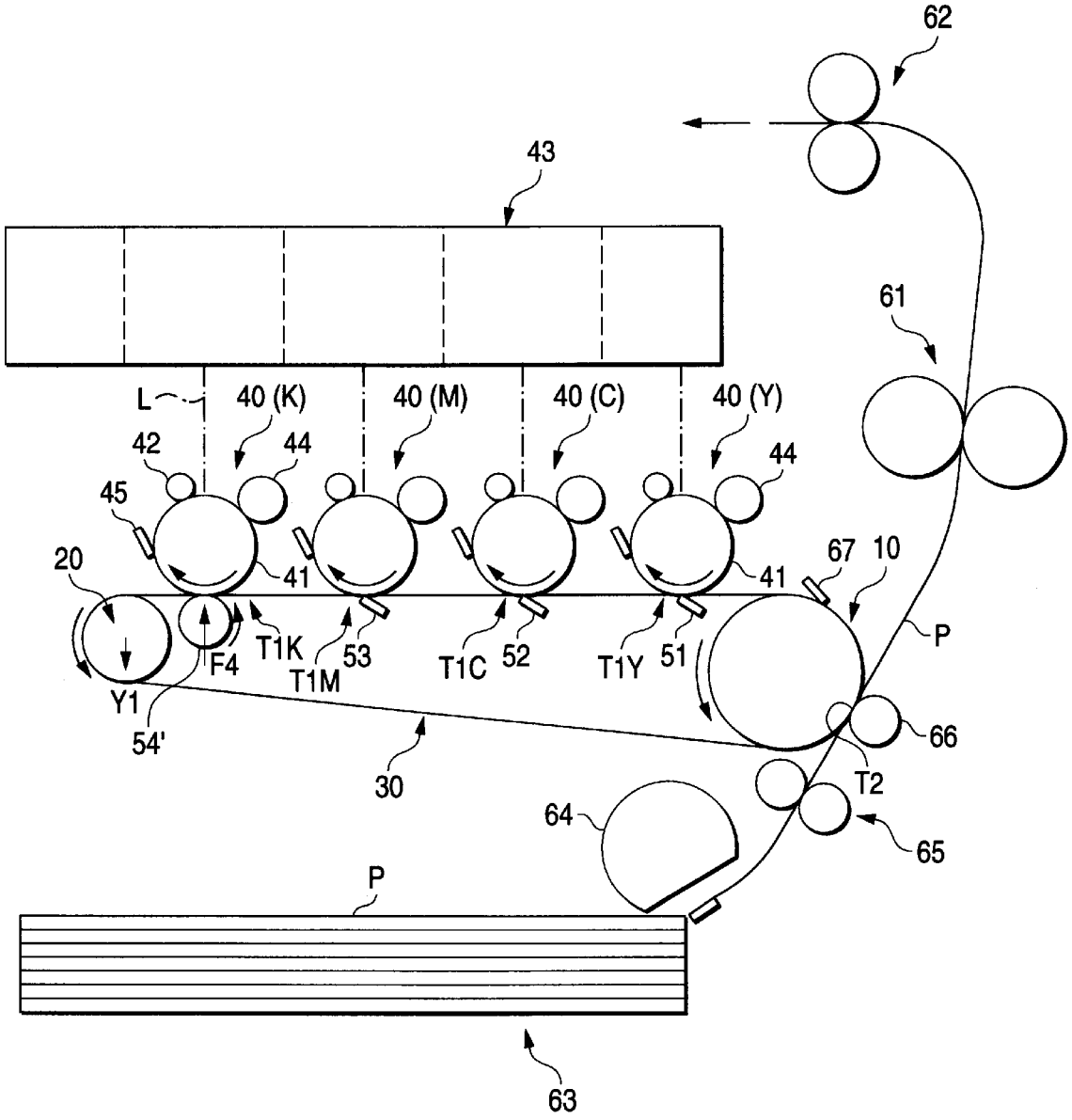
FIG. 4 is a schematic front view to show a color image formation apparatus according to a third embodiment of the invention.

FIG. 4 is a schematic front view to show a color image formation apparatus according to a third embodiment of the invention. Parts identical with or similar to those previously described with reference to FIG. 3A in the second embodiment are denoted by the same reference numerals.

The third embodiment differs from the second embodiment in that primary transferring member 54' closest to a regulation roller 20 is implemented as a transfer roller for urging a belt 30 toward a single-color toner image former 40 (K) by a larger force F4 than the force produced by the regulation roller 20 for bringing the belt 30 away from the single-color toner image former.

In a case where the transfer blade is used to circumvent the displacement of the intermediate transfer belt 30 in the direction (Y1) bringing the belt 30 away from the single-color toner image former 40, the frictional force between the transfer blade and the intermediate transfer belt 30 grows with an increase in the urging force and therefore the configuration is not preferred.

In contrast, according to the color image formation apparatus of this embodiment, since the primary transferring member closest to the regulation roller 20 is implemented as the transfer roller 54' for urging the belt 30 toward the single-color toner image former 40 (K) by the larger force F4 than the force produced by the regulation roller 20 for bringing the belt 30 away from the single-color toner image former, the contact state between the intermediate transfer belt 30 and the photoconductor 41 of the toner image former in a transfer section T1K becomes stable. If the urging force F4 is increased, the frictional force with the intermediate transfer belt 30 does not grow and consequently a smooth running state of the intermediate transfer belt 30 can be provided.

Figure 5:
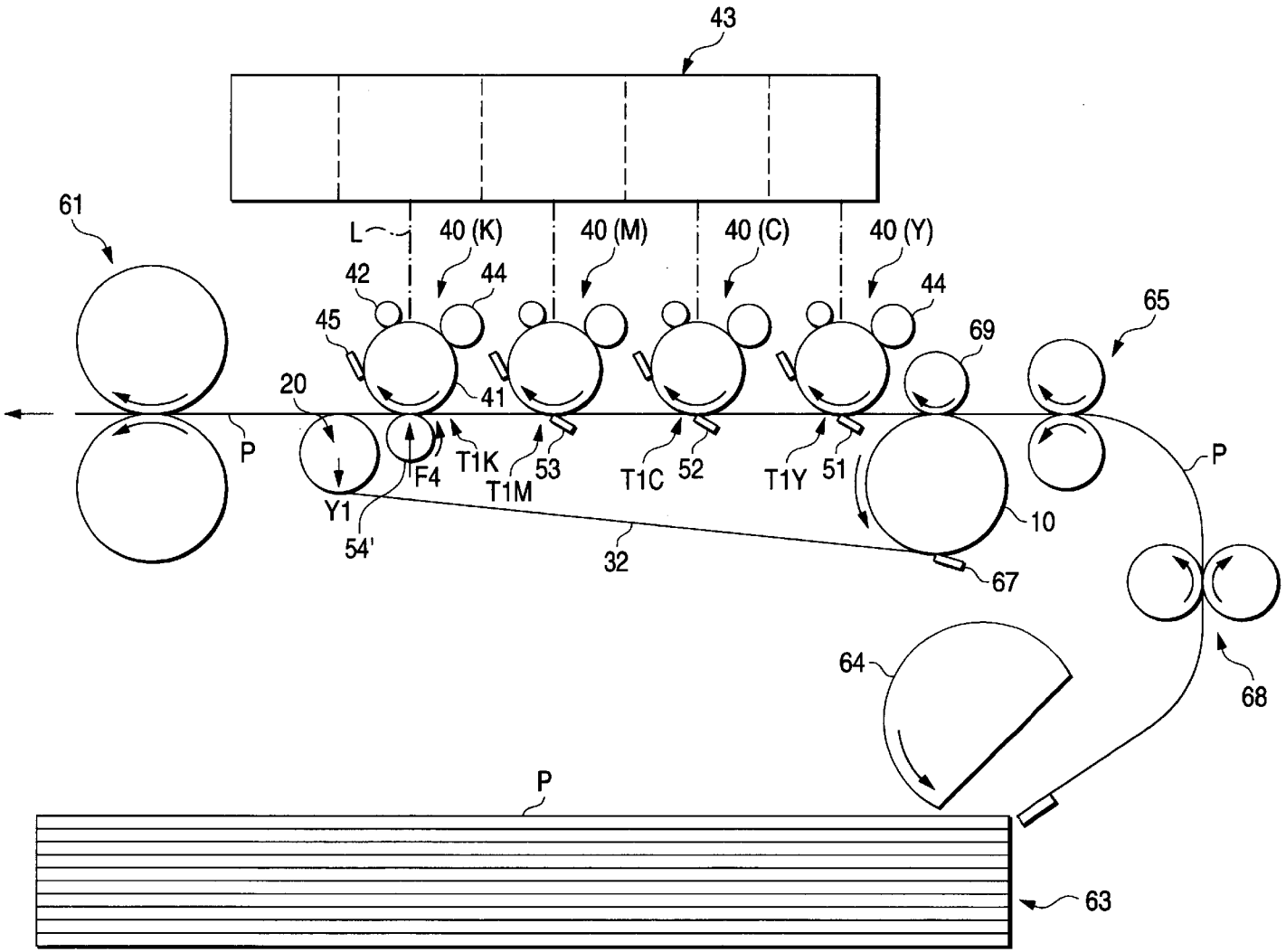
FIG. 5 is a schematic front view to show a color image formation apparatus according to a fourth embodiment of the invention.

FIG. 5 is a schematic front view to show a color image formation apparatus according to a fourth embodiment of the invention. Parts identical with or similar to those previously described with the third embodiment are denoted by the same reference numerals.

The fourth embodiment differs from the third embodiment only in that a holding belt 32 for holding a recording medium P is used as a belt in place of the intermediate transfer belt 30 and toner images provided by a plurality of single-color toner image formers 40 (Y, C, M, and K) are transferred to the recording medium P held on the belt 32 in sequence by separate transferring members 51, 52, 53 and 54'.

In FIG. 5, numeral 68 denotes a transport roller pair for transporting the-recording medium P to a gate roller pair 65, and numeral 69 denotes a roller for holding the recording medium P on the holding belt 32.

According to the embodiment, similar advantages to those of the third embodiment described above can also be provided.

Since the transfer roller 54 of a last transfer section T1K transports the recording medium P reliably, the recording medium P enters a fixing roller pair 61 smoothly and becomes hard to wrinkle.

Each of the transferring members 51, 52, and 53 other than the transfer roller 54 may be implemented as a discharge-type transfer device (corona transfer device).

Figure 6:
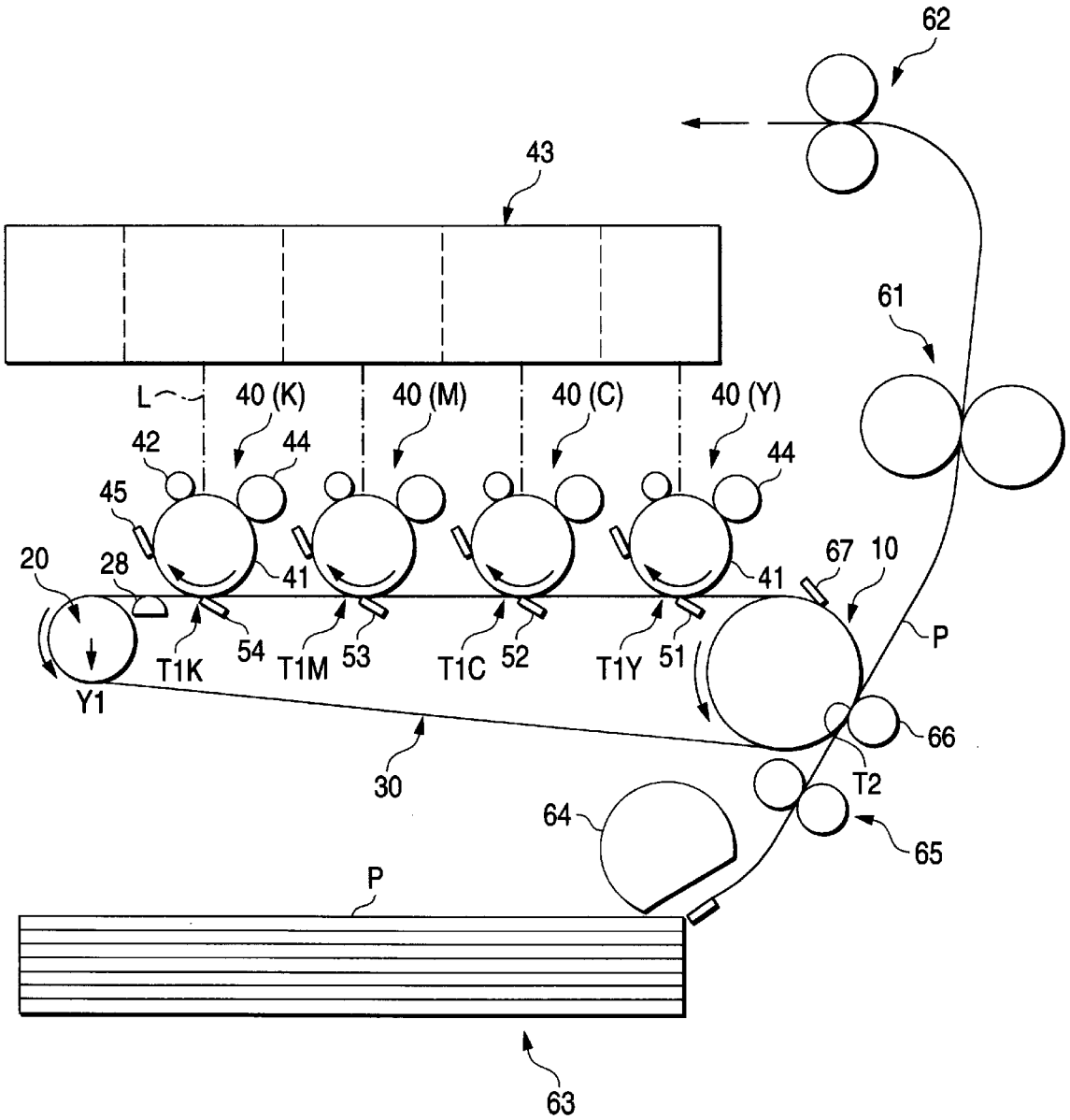
FIG. 6 is a schematic front view to show a color image formation apparatus according to a fifth embodiment of the invention.

FIG. 6 is a schematic front view to show a color image formation apparatus according to a fifth embodiment of the invention. Parts identical with or similar to those previously described with reference to FIG. 4 in the third embodiment are denoted by the same reference numerals.

The fifth embodiment differs from the third embodiment in that a positioning member 28 for abutting the back face of a belt 30 for positioning the belt 30 is placed between a regulation roller 20 and a transfer section T1K closest to the regulation roller 20.

The positioning member 28 is formed of a rod-like body which is semicircular in cross section, extending over the full length of the belt 30 in the width direction thereof, and is fixed at both ends to a fixation frame (not shown). At least the contact part of the positioning member 28 with the back face of the belt 30 is made of a material having a good sliding proper relative to the back of the belt 30.

According to this configuration, even if the regulation roller 20 is displaced in the arrow Y1 direction, the contact between the intermediate transfer belt 30 and the photoconductor 41 of the toner image former in the primary transfer section T1K becomes stable, causing no transfer failure to occur.

Since the positioning member 28 has a good sliding proper relative to the back of the belt 30, the frictional force with the intermediate transfer belt 30 does not much grow and consequently a smooth running state of the intermediate transfer belt 30 can be provided.

Each of the transferring members 51, 52, 53, and 54 of this embodiment is implemented as a transfer blade, but may be implemented as a corona transfer device.

Therefore, this embodiment eliminates the need for implementing the transferring member as transfer rollers, and makes it possible to implement the transferring member as transfer blades or corona transfer devices, so that it is made possible to provide an inexpensive image formation apparatus with a simple structure.

Figure 7:
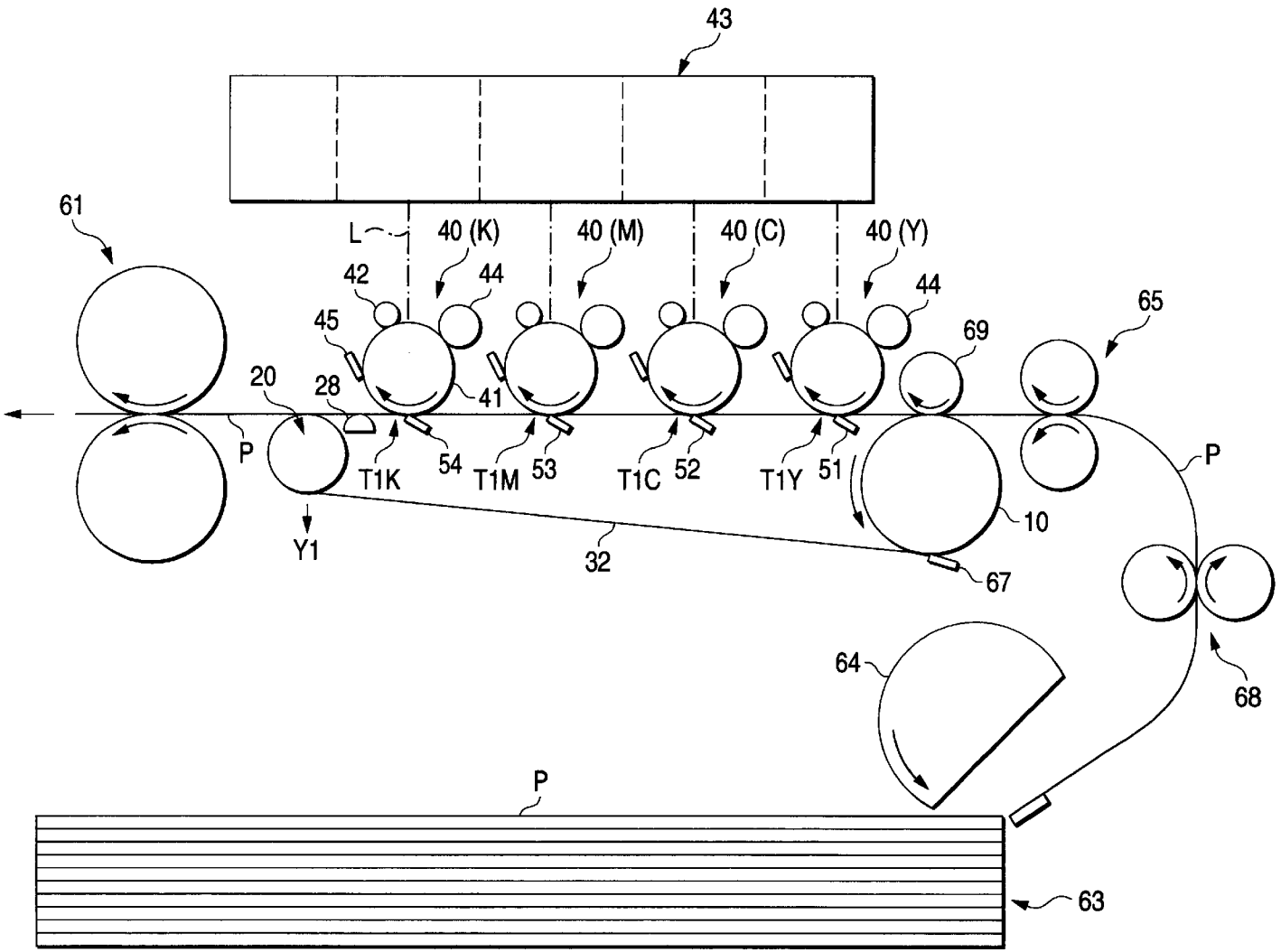
FIG. 7 is a schematic front view to show a color image formation apparatus according to a sixth embodiment of the invention.

FIG. 7 is a schematic front view to show a color image formation apparatus according to a sixth embodiment of the invention. Parts identical with or similar to those previously described with reference to the fifth embodiment are denoted by the same reference numerals.

The sixth embodiment differs from the fifth embodiment only in that a holding belt 32 for holding a recording medium P is used as a belt in place of the intermediate transfer belt 30 and toner images provided by a plurality of single-color toner image formers 40 (Y, C, M, and K) are transferred to the recording medium P held on the belt 32 in sequence by separate transferring members 51 to 54.

According to this embodiment, similar advantages to those of the fifth embodiment described above can also be provided.

Figure 8:
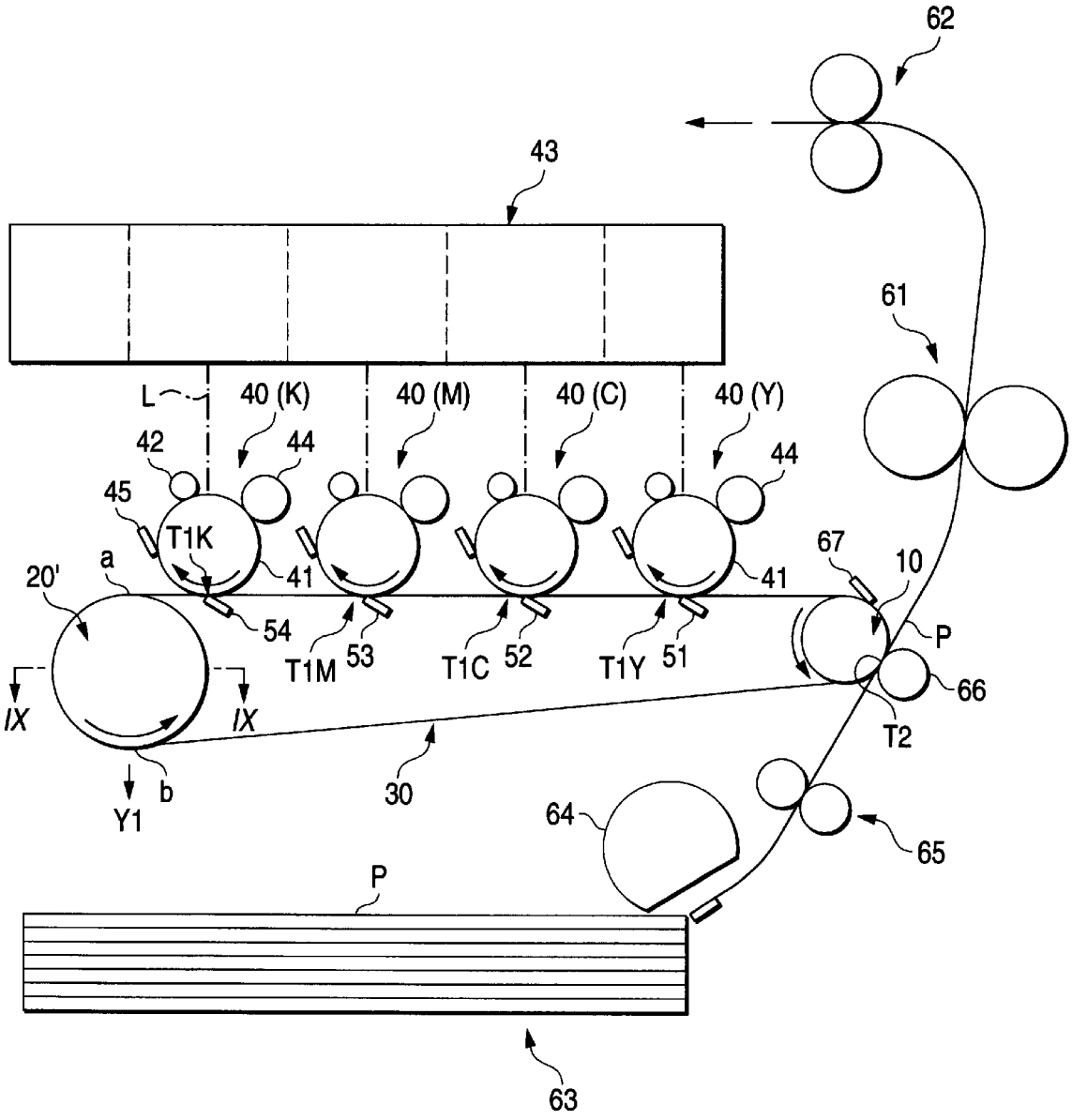
FIG. 8 is a schematic front view to show a color image formation apparatus according to a seventh embodiment of the invention.

FIG. 8 is a schematic front view to show a color image formation apparatus according to a seventh embodiment of the invention. Parts identical with or similar to those previously described with the first embodiment are denoted by the same reference numerals.

The seventh embodiment differs from the first embodiment only in that a driven roller 20' has a larger diameter than a drive roller 10.

The secondary transfer section T2 is implemented as a secondary transfer roller 66 pressed against the drive roller 10 via an intermediate transfer belt 30 in the winding part of the intermediate transfer belt 30 around the drive roller 10.

The driven roller 20' is implemented as a meander regulation roller of the intermediate transfer belt 30.

Figure 9:
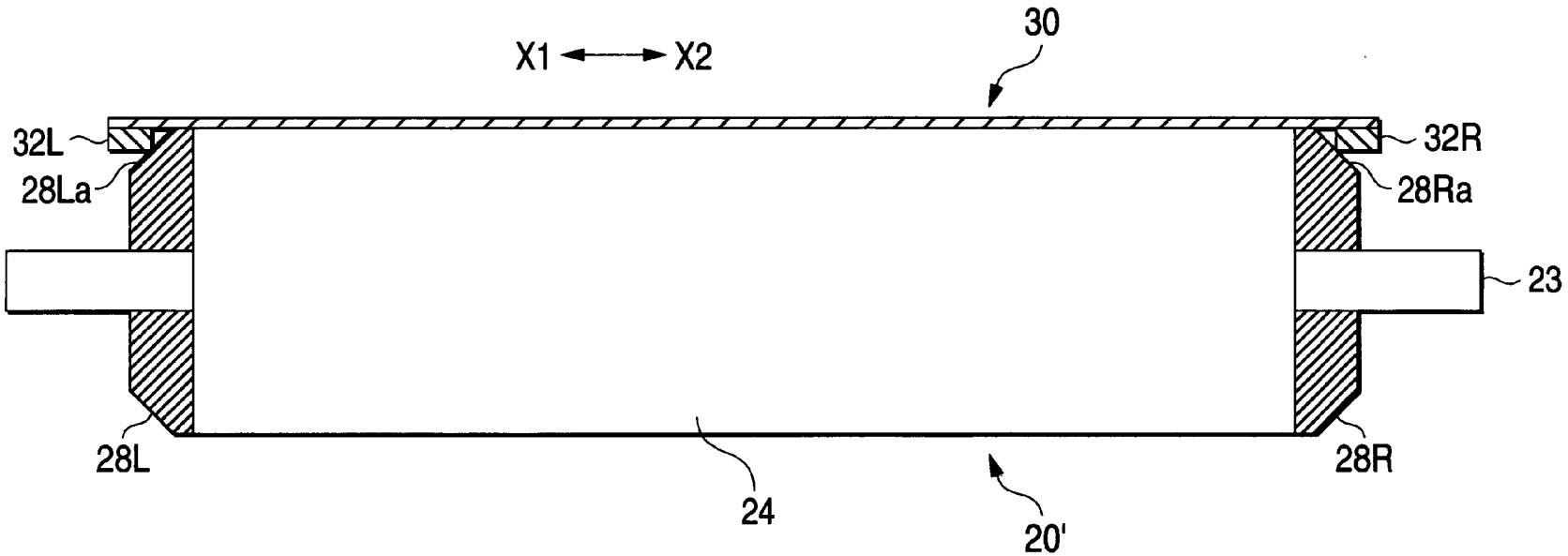
FIG. 9 is a sectional view taken on a line IX—IX of FIG. 8.

An appropriate configuration can be adopted; in the embodiment, as shown in FIG. 9, beads 32R and 32L are placed along both sides of the back face of the intermediate transfer belt 30 and the driven roller 20' is provided with regulation rings 28R and 28L that can rotate independently of a roller main body 24 relative to a shaft 23, whereby the driven roller 20' is implemented as the meander regulation roller.

In FIG. 9, if the intermediate transfer belt 30 attempts to move (meander) in the arrow X1 direction, the bead 32R abuts a slope 28Ra of the regulation ring 28R in the process from a winding start part a around the regulation roller 20' to a winding end part b (see FIG. 8), regulating the move of the intermediate transfer belt 30. To the contrary, if the intermediate transfer belt 30 attempts to move in the arrow X2 direction, the bead 32L abuts a slope 28La of the regulation ring 28L, regulating the move of the intermediate transfer belt 30. Accordingly, meander of the intermediate transfer belt 30 is regulated.

According to the above configuration, since the drive roller 10 which is a main factor member of causing meander to occur, has a smaller diameter than the driven roller 20', the meander distance itself of the intermediate transfer belt 30 is decreased.

On the other hand, since the driven roller 20' implemented as the meander regulation roller of the intermediate transfer belt 30 has a larger diameter than the drive roller 10, and thus the winding length defined between parts a and b of the intermediate transfer belt 30 around the driven roller (meander regulation roller) 20 (see FIG. 8) is enlarged, meander of the intermediate transfer belt 30 is regulated reliably and smoothly.

Therefore, the color image formation apparatus can provide a sufficient meander regulation effect and consequently the image quality is improved.

Figure 10:
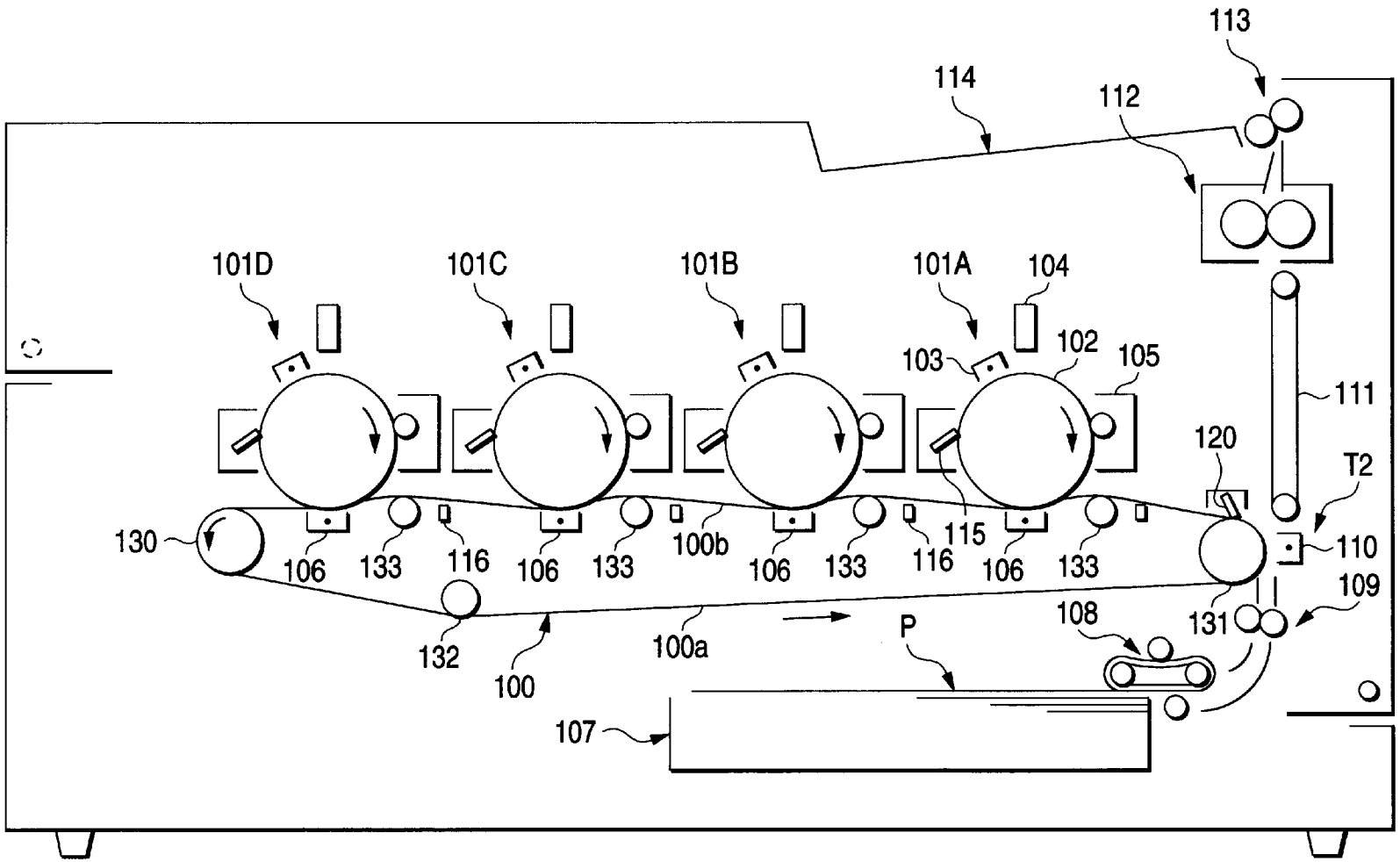
FIG. 10 is a schematic front view to show a related color image formation apparatus.
Figure 11:
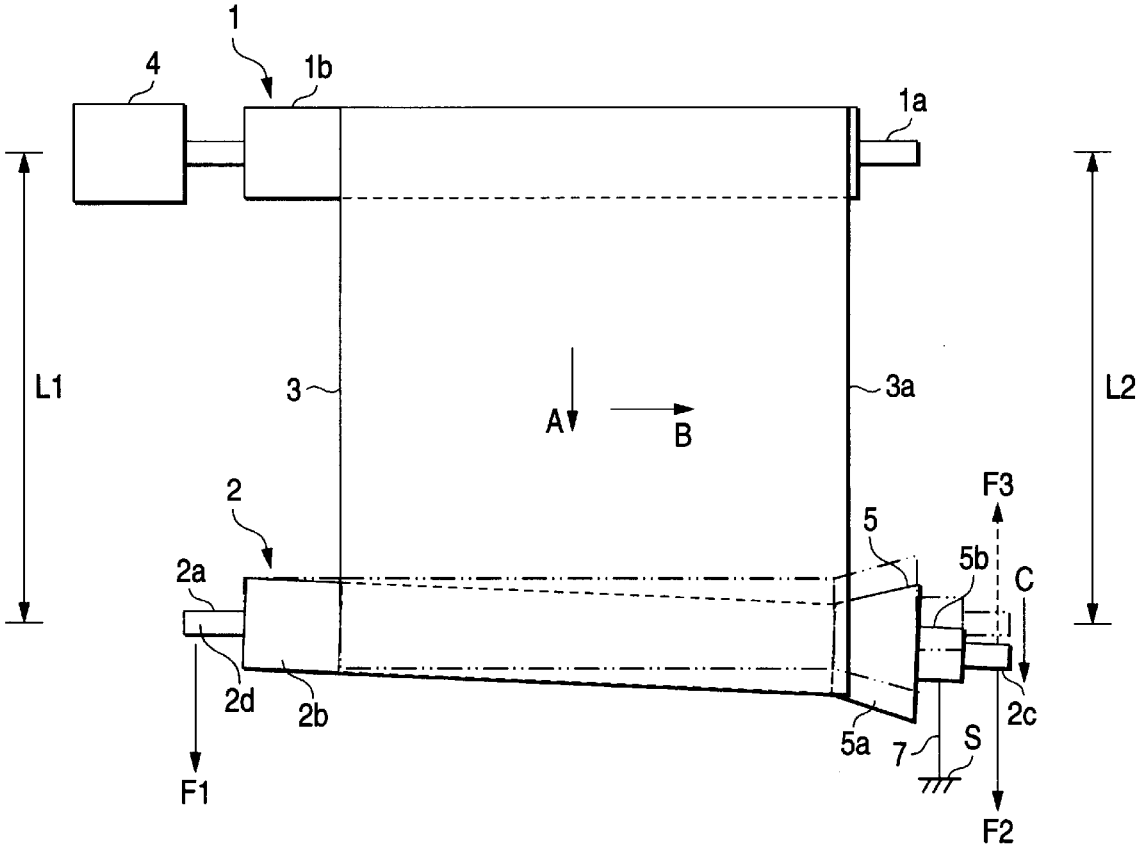
FIG. 11 is a schematic plan view to show a related belt stretcher.

Further, meander regulation rollers (tension roller 132, press roller 133, etc., previously described with reference to FIG. 10) other than the driven roller 20' become unnecessary, so that it is made possible to downsize the apparatus.

Still further, the secondary transfer section T2 is formed in the winding part of the intermediate transfer belt 30 around the drive roller 10 which is not the meander regulation roller, so that a stable secondary transfer state can be provided.

Moreover, the drive roller 10 forming the secondary transfer section T2 has a small diameter, so that the strip property of the recording medium P from the secondary transfer section T2 is improved and winding trouble of the recording medium P becomes hard to occur.

As described above, the color image formation apparatus can provide the advantages that the number of rollers can be lessened for downsizing the apparatus, that a sufficient meander regulation effect can be provided for improving the image quality, and that winding trouble of the recording medium becomes hard to occur.

The meander regulation mechanism described with reference to FIGS. 3A and 3B is applicable to the drive roller 20' of the seventh embodiment. In such a configuration, in addition to the advantages described in the seventh embodiment, there is also obtained the same advantages attained by the meander regulation mechanism shown in FIG. 3A Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image;

a plurality of transferring members, disposed on a circulating path of the belt member, each transferring member being associated with each image former for transferring the toner image onto the belt member; and a cleaning blade, abutted against a part of the belt member wound on the drive roller for removing toner remained on the belt member after the toner image transfer is performed.

2. The color image formation apparatus as set forth in claim 1, wherein:

the drive roller serves as a secondary transferring member which transfers the toner image from the belt member onto a recording medium, together with a transferring roller; and a diameter of the driven roller is larger than a diameter of the drive roller.

3. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image;

a plurality of transferring members, disposed on a circulating path of the belt member, each transferring member being associated with each image former for transferring the toner image onto either the belt member or a recording medium held on the belt member; and a cleaning blade, abutted against a part of the belt member wound on the drive roller for removing toner remained on the belt member after the toner image transfer is performed, wherein a friction coefficient of an outer peripheral surface of the drive roller is larger then a friction coefficient of an inner surface of the looped belt member.

4. The color image formation apparatus as set forth in claim 3, wherein:

the drive roller serves as a secondary transferring member together with a transfer roller in a case where the toner images are primarily transferred onto the belt member; and a hardness of the outer peripheral surface of the drive roller is smaller than a hardness of the transfer roller.

5. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image;

a plurality of transferring members, disposed on a circulating path of the belt member, each transferring member being associated with each image former for transferring the toner image onto either the belt member or a recording medium held on the belt member; and a cleaning blade, abutted against a part of the belt member wound on the drive roller for removing toner remained on the belt member after the toner image transfer is performed, wherein the driven roller serves as a regulation roller, which moves in a direction other than a direction in which the driven roller initially stretches the belt member to regulate meander action of the belt member.

6. The color image formation apparatus as set forth in claim 5, wherein the driven roller moves in a direction perpendicular to the initial stretching direction to regulate the meander action.

7. The color image formation apparatus as set forth in claim 5, wherein the driven roller moves in a direction such that a part of the belt member at which a transferring member closest to the driven roller is separated from the associated image former.

8. The color image formation apparatus as set forth in claim 7, wherein the transferring member closest to the driven roller is provided as a transfer roller for urging the belt member toward the associated image former with an urging force greater than a force produced when the driven roller regulates the meander action of the belt member.

9. The color image formation apparatus as set forth in claim 8, wherein the transferring members other than the transfer roller are provided as transfer blades.

10. The color image formation apparatus as set forth in claim 7, further comprising a positioning member disposed between the driven roller and the transferring member closest to the driven roller, the positioning member being abutted against an inner surface of the looped belt member, wherein a friction coefficient of an abutting surface of the positioning member is less than a friction coefficient of the inner surface of the looped belt member.

11. The color image formation apparatus as set forth in claim 10, wherein all of the transferring members are provided as either transfer blades or corona transfer devices.

12. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image; and a plurality of transferring members, disposed on a circulating path of the belt member, each transferring member being associated with each image former for transferring the toner image onto either the belt member or a recording medium held on the belt member, wherein:

the driven roller serves as a regulation roller, which moves in a direction other than a direction in which the driven roller initially stretches the belt member such that a part of the belt member at which a transferring member closest to the driven roller is provided is separated from the associated image former, in order to regulate meander action of the belt member; and the transferring member closest to the driven roller is provided as a first transfer roller for urging the belt member toward the associated image former with an urging force greater than a force produced when the driven roller regulates the meander action of the belt member.

13. The color image formation apparatus as set forth in claim 12, wherein the driven roller moves in a direction perpendicular to the initial stretching direction to regulate the meander action.

14. The color image formation apparatus as set forth in claim 12, wherein the transferring members other than the first transfer roller are provided as transfer blades.

15. The color image formation apparatus as set forth in claim 12, further comprising a cleaning blade, abutted against a part of the belt member wound on the drive roller for removing toner remained on the belt member after the toner image transfer is performed.

16. The color image formation apparatus as set forth in claim 15, wherein a friction coefficient of an outer peripheral surface of the drive roller is larger than a friction coefficient of an inner surface of the looped belt member.

17. The color image formation apparatus as set forth in claim 16, wherein:

the drive roller serves as a secondary transferring member together with a second transfer roller in a case where the toner images are primarily transferred onto the belt member; and a hardness of the outer peripheral surface of the drive roller is smaller than a hardness of the second transfer roller.

18. The color image formation apparatus as set forth in claim 12, wherein:

the drive roller serves as a secondary transferring member together with a second transfer roller in a case where the toner images are primarily transferred onto the belt member; and a diameter of the driven roller is larger than a diameter of the drive roller.

19. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image;

a plurality of transferring members, disposed on a circulating path of the belt member, each transferring member being associated with each image former for transferring the toner image onto either the belt member or a recording medium held on the belt member; and a positioning member disposed between the driven roller and a transferring member closest to the driven roller, the positioning member being abutted against an inner surface of the looped belt member, wherein:

the driven roller serves as a regulation roller, which moves in a direction other than a direction in which the driven roller initially stretches the belt member such that a part of the belt member at which the transferring member closest to the driven roller is provided is separated from the associated image former, in order to regulate meander action of the belt member; and a friction coefficient of an abutting surface of the positioning member is less than a friction coefficient of the inner surface of the looped belt member.

20. The color image formation apparatus as set forth in claim 19, wherein the driven roller moves in a direction perpendicular to the initial stretching direction to regulate the meander action.

21. The color image formation apparatus as set forth in claim 19, wherein all of the transferring members are provided as either transfer blades or corona transfer devices.

22. The color image formation apparatus as set forth in claim 19, further comprising a cleaning blade, abutted against a part of the belt member wound on the drive roller for removing toner remained on the belt member after the toner image transfer is performed.

23. The color image formation apparatus as set forth in claim 22, wherein a friction coefficient of an outer peripheral surface of the drive roller is larger than a friction coefficient of an inner surface of the looped belt member.

24. The color image formation apparatus as set forth in claim 23, wherein:

the drive roller serves as a secondary transferring member together with a transfer roller in a case where the toner images are primarily transferred onto the belt member; and a hardness of the outer peripheral surface of the drive roller is smaller than a hardness of the transfer roller.

25. The color image formation apparatus as set forth in claim 19, wherein:

the drive roller serves as a secondary transferring member together with a transfer roller in a case where the toner images are primarily transferred onto the belt member; and a diameter of the driven roller is larger than a diameter of the drive roller.

26. A color image formation apparatus, comprising:

a drive roller having a first diameter;

a driven roller having a second diameter larger than the first diameter;

a looped belt member, which is stretched by the drive roller and the driven roller and circulated therearound;

a plurality of image formers, each forming a toner image associated with each single color constituting a color image;

a plurality of transferring members, disposed on a circulating path of the belt member, each transferring member being associated with each image former for primarily transferring the toner image onto the belt member; and a first transfer roller, which urges the belt member toward the drive roller to transfer the toner image on the belt member onto a recording medium placed therebetween.

27. The color image formation apparatus as set forth in claim 26, wherein a cleaning blade, abutted against a part of the belt member wound on the drive roller for removing toner remained on the belt member after the primarily transferred toner image is transferred onto the recording medium.

28. The color image formation apparatus as set forth in claim 27, wherein a friction coefficient of an outer peripheral surface of the drive roller is larger than a friction coefficient of an inner surface of the looped belt member.

29. The color image formation apparatus as set forth in claim 28, wherein a hardness of the outer peripheral surface of the drive roller is smaller than a hardness of the first transfer roller.

30. The color image formation apparatus as set forth in claim 26, wherein the driven roller serves as a regulation roller, which moves in a direction other than a direction in which the driven roller initially stretches the belt member to regulate meander action of the belt member.

31. The color image formation apparatus as set forth in claim 30, wherein the driven roller moves in a direction perpendicular to the initial stretching direction to regulate the meander action.

32. The color image formation apparatus as set forth in claim 30, wherein the driven roller moves in a direction such that a part of the belt member at which a transferring member closest to the driven roller is separated from the associated image former.

33. The color image formation apparatus as set forth in claim 32, wherein the transferring member closest to the driven roller is provided as a second transfer roller for urging the belt member toward the associated image former with an urging force greater than a force produced when the driven roller regulates the meander action of the belt member.

34. The color image formation apparatus as set forth in claim 33, wherein the transferring members other than the second transfer roller are provided as either transfer blades or corona transfer devices.

35. The color image formation apparatus as set forth in claim 32, further comprising a positioning member disposed between the driven roller and the transferring member closest to the driven roller, the positioning member being abutted against an inner surface of the looped belt member, wherein a friction coefficient of an abutting surface of the positioning member is less than a friction coefficient of the inner surface of the looped belt member.

36. The color image formation apparatus as set forth in claim 35, wherein all of the transferring members are provided as either transfer blades or corona transfer devices.

37. A belt stretcher, comprising:

a drive roller;

a driven roller; and a looped belt member, which is stretched by the drive roller and the driven roller and circulated therearound, wherein the driven roller serves as a regulation roller, which moves in a direction other than a direction in which the driven roller initially stretches the belt member.

38. The color image formation apparatus as set forth in claim 37, wherein the driven roller moves in a direction perpendicular to the initial stretching direction to regulate a meander action.

39. The color image formation apparatus as set forth in claim 37, wherein a diameter of the driven roller is larger than a diameter of the drive roller.

40. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image; and a plurality of transferring members, disposed on a circulating path of the belt member, each transferring member being associated with each image former for transferring the toner inmage onto either the belt member or a recording medium held on the belt member;

wherein the driven roller serves as a regulation roller, which moves in a direction other than a direction in which the driven roller initially stretches the belt member to regulate meander action of the belt member.

41. A color image formation apparatus, comprising:

a drive roller;

a driven roller;

a looped belt member, which is stretched by the drive roller and the driven roller and circulated therearound;

a plurality of image formers, each forming a toner image associated with each single color constituting a color image; and a plurality of primary transferring members, disposed on a circulating path of the belt member, each primary transferring member being associated with each image former for transferring the toner image onto the belt member, wherein:

the drive roller serves as a secondary transferring member which transfers the toner image from the belt member onto a recording medium, together with a transferring roller; and a diameter of the driven roller is larger than a diameter of the drive roller.

* * * * *